US006134398A

United States Patent [19]

Grace

[11] Patent Number: 6,134,398

[45] Date of Patent: Oct. 17, 2000

[54] ELECTROSTATOGRAPHIC REPRODUCTION MACHINE HAVING DUAL MODE DEVELOPMENT UNIT CONTROL APPARATUS AND METHOD

[75] Inventor: Robert E. Grace, Fairport, N.Y.

[73] Assignee: Xerox Corporation, Stamford, Conn.

[21] Appl. No.: 09/219,730

[22] Filed: Dec. 22, 1998

[51] Int. Cl.[7] ..... G03G 15/08

[52] U.S. Cl. ..... 399/58; 399/60

[58] Field of Search ..... 399/27–29, 53, 399/58–59, 61, 223–224, 252, 254, 60; 347/131, 170; 358/296

[56] References Cited

U.S. PATENT DOCUMENTS

| | | | |
|---|---|---|---|
| 5,202,769 | 4/1993 | Suzuki | 399/58 X |
| 5,204,698 | 4/1993 | LeSueur et al. | 347/140 |
| 5,787,320 | 7/1998 | Eun et al. | 399/59 |
| 5,828,933 | 11/1998 | Rees et al. | 399/223 |
| 5,887,221 | 3/1999 | Grace | 399/27 X |

*Primary Examiner*—Quana M. Grainger
*Attorney, Agent, or Firm*—Tallam I. Ngliti

[57] ABSTRACT

A method and apparatus in an electrostatographic reproduction machine having a plurality of development units for reliably producing high quality toner particle images under varying sustained area toner coverage conditions. The apparatus employing the method includes a control system (a) for reading a stored area toner coverage level threshold value; a first operating time control algorithm and a second operating time control algorithm for adding and admixing in each development unit of the plurality of development units; (b) for measuring sustained area toner coverage levels of images being reproduced during a reproduction job; (c) for comparing the measured sustained area toner coverage levels of images being reproduced with the stored area toner coverage level threshold value; and (d) for changing the operating time control algorithm for adding and admixing in each development unit between the first operating time control algorithm and the second operating time control algorithm depending on a result of comparing the measured sustained area toner coverage levels of images being reproduced with the stored threshold value.

12 Claims, 2 Drawing Sheets

FIG. 2
PRIOR ART
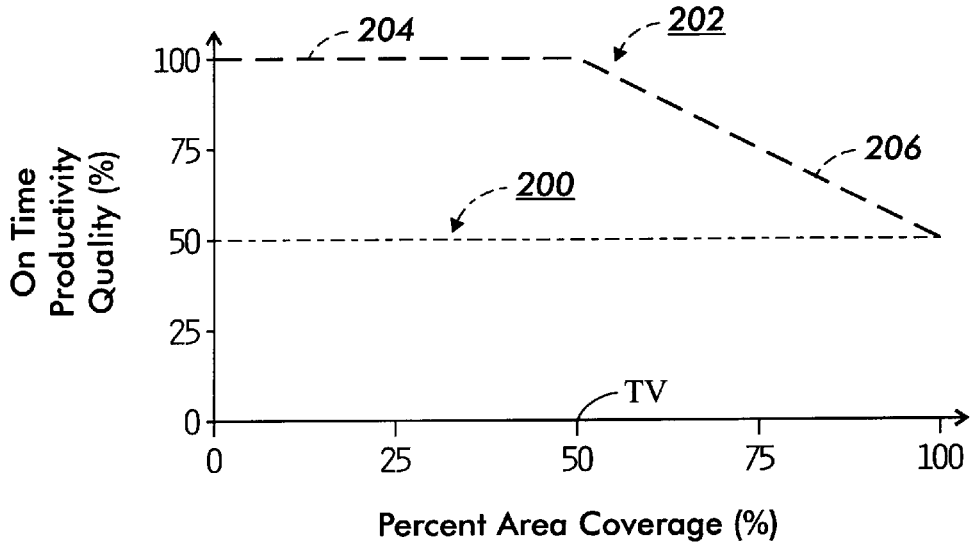
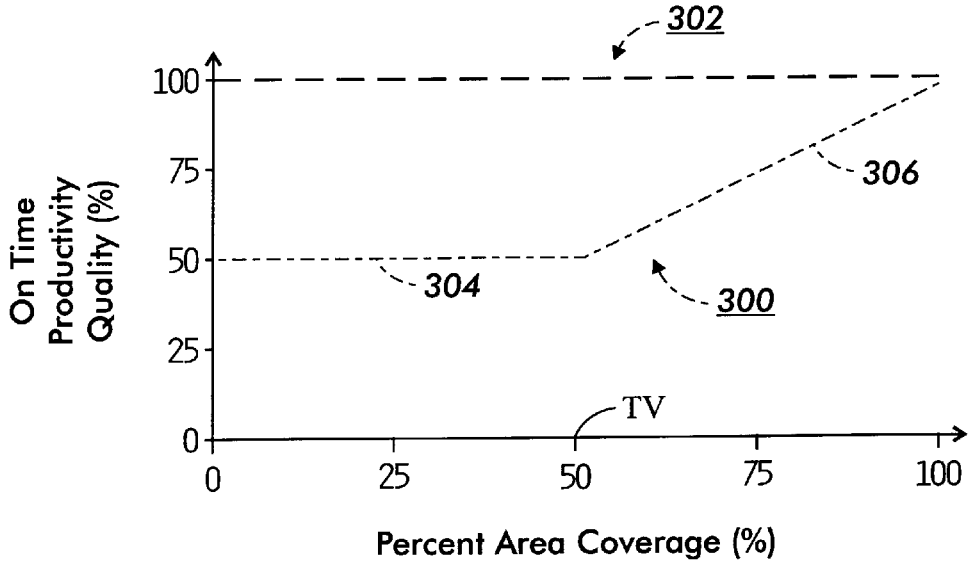
FIG. 3

ELECTROSTATOGRAPHIC REPRODUCTION MACHINE HAVING DUAL MODE DEVELOPMENT UNIT CONTROL APPARATUS AND METHOD

BACKGROUND OF THE INVENTION

This invention relates generally to an electrostatographic printing machine, and more particularly concerns electrostatographic reproduction machines including dual mode development unit control apparatus and method for optimizing machine operating conflicts under relatively high and sustained area toner coverage, or toner area coverage conditions.

In an electrostatographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in irradiated areas. This records an electrostatic latent image on the photoconductive member corresponding to the informational areas contained within the original document being reproduced.

After the electrostatic latent image is recorded on the photoconductive member, the latent image is developed by bringing developer material containing charged toner particles, for example, black toner particles, into contact therewith. Developer material can be single component comprising only of charged toner particles, or it may be dual component comprising carrier particles and toner particles that are triboelectrically charged when admixed or mixed with the carrier particles. In either case, bringing the developer material into contact with the latent image forms a toner image on the photoconductive member which is subsequently transferred to a copy sheet. The copy sheet is then separated from the photoconductive member and the toner powder is fed on the copy sheet through a fusing apparatus where it is heated to permanently affix it to the copy sheet, thus forming a black and white copy of the original document.

Multi-color electrostatographic printing machines which use multi-colored toners are substantially identical in each color image forming process to the foregoing process of black and white printing which uses only black toner. However, rather than forming a single latent image on the photoconductive surface, several single color latent images corresponding to color separated light images of the original document are recorded thereon. Each single color electrostatic latent image is developed with toner particles of a color complementary thereto. This process may be performed in a single pass, or in multipasses during which image formation is repeated a plurality of cycles for differently colored images using their respective complementarily colored toner particles to form color toner images. Each single color toner powder image is transferred to a copy sheet in superimposed registration with the other toner powder images.

This creates a composite multi-layered toner powder image on the copy sheet. The copy sheet is separated from the photoconductive member and, thereafter, the multi-layered toner powder image on the sheet is fed through a fusing apparatus and permanently affixed to the copy sheet, thus creating a color copy of the original multi-color document. In a black and white or multi-color electrostatographic printing machine, the copy sheet is typically brought into moving contact with the photoconductive member during toner powder image transfer to the copy sheet. A sheet transport apparatus is typically provided for receiving the copy sheet incrementally as it is incrementally separated from the photoconductive member, and for transporting the copy sheet towards and into the fusing apparatus.

Multipass color electrostatographic reproduction machines are usually designed so that they each have a controller that includes a fixed development unit operating or on time control algorithm or method which is optimized for typical operating conditions of each machine. For example, in continuous operation of a four color four pass electrostatographic reproduction machine, each development unit typically adds, admixes or mixes and develops toner for approximately 25% of the total machine operating time. Unfortunately, such a controller usually requires performance tradeoffs when the machine is operating and producing reproductions each having high area toner coverage, and consequently requiring high rates of toner depletion and toner replenishment (in other words high rates of toner throughput) during the fixed operating times. In order to maintain the concentration of toner particles within the developer material at a desired level that would insure the quality of subsequent images, the depleted toner particles must be replenished with fresh toner particles. Such fresh toner particles must then be admixed with the carrier particles in order to properly charge them triboeletrically.

Tradeoffs are necessary because it is very difficult to design toner materials and compact mixing apparatus which enables high image quality while replenishing toner at 100% of the maximum depletion rate (that is, at 100% area coverage). Maintaining constant toner concentration at area toner coverage levels above 50%, the resultant high replenishment and admix rates often result in undesirable side effects such as background development and excessive contamination. One possible way to avoid these side effects is to limit the maximum toner dispense rate to approximately 50% of the maximum toner depletion rate. In sustained operation at high area toner coverage levels, this will cause the toner concentration to decline by a large amount and will produce objectionable degradation of image quality. Another common solution is to suspend imaging when the toner concentration has fallen by a small amount and allow the development unit and toner dispenser to run and mix until toner is replenished to normal levels, thereby sacrificing productivity (measured by prints per unit time). This however may result in customer dissatisfaction with the operation of the machine, particularly with small development unit capacity machines.

Operating a four color multicolor printing machine with toner depletion and replenishment as above, involves a number of conflicts. On the one hand, in order to insure optimum toner concentration as well as optimally charged toner particles from toner replenishment and subsequent necessary admix or mixing, it would be desirable to keep all development units constantly replenishing and mixing toner particles 100% of the time when this option is enabled by the process architecture. This would spread necessary toner replenishment over the longest possible time and at the lowest possible replenishment rate. This desire is counteracted on the other hand by a need to minimize developer material aging from over mixing, and by a desire to switch development units off whenever possible in order to minimize their power consumption and audible noise.

Any level of fixed development unit replenishment and mixing "on" time in a multipass electrostatographic reproduction machine results in a compromise in performance at some toner throughput rate as determined by area toner coverage. If the development unit replenishment and mixing "on" time is minimized, then image quality or productivity must be compromised at high throughput and high area toner coverage levels. If the development unit replenishment and mixing "on" time is maximized, then developer life, noise, and power consumption must be compromised at low throughput.

SUMMARY OF THE INVENTION

A method and apparatus in an electrostatographic reproduction machine having a plurality of development units for reliably producing high quality toner particle images under varying sustained area toner coverage, or toner area coverage conditions. The apparatus employing the method includes a control system (a) for reading a stored area toner coverage level threshold value; a first operating time control algorithm and a second operating time control algorithm for the adding and admixing or replenishment and mixing function of each development unit of the plurality of development units; (b) for measuring sustained area toner coverage levels of images being reproduced during a reproduction job; (c) for comparing the measured sustained area toner coverage levels of images being reproduced with the stored area toner coverage level threshold value; and (d) for changing the operating time control algorithm of the adding and admixing function of each development unit between the first operating time control algorithm and the second operating time control algorithm depending on a result of comparing the measured sustained area toner coverage levels of images being reproduced with the stored threshold value.

BRIEF DESCRIPTION OF THE DRAWINGS

These and other aspects of the present invention will become apparent from the following description in conjunction with the accompanying drawings in which:

FIG. 2 is a graphical illustration of a prior art single, fixed mode development unit control method for the development units of a reproduction machine; and FIG. 3 is a graphical illustration of the dual mode development unit control method in accordance with the present invention.

DETAILED DESCRIPTION OF THE INVENTION

Figure 1:
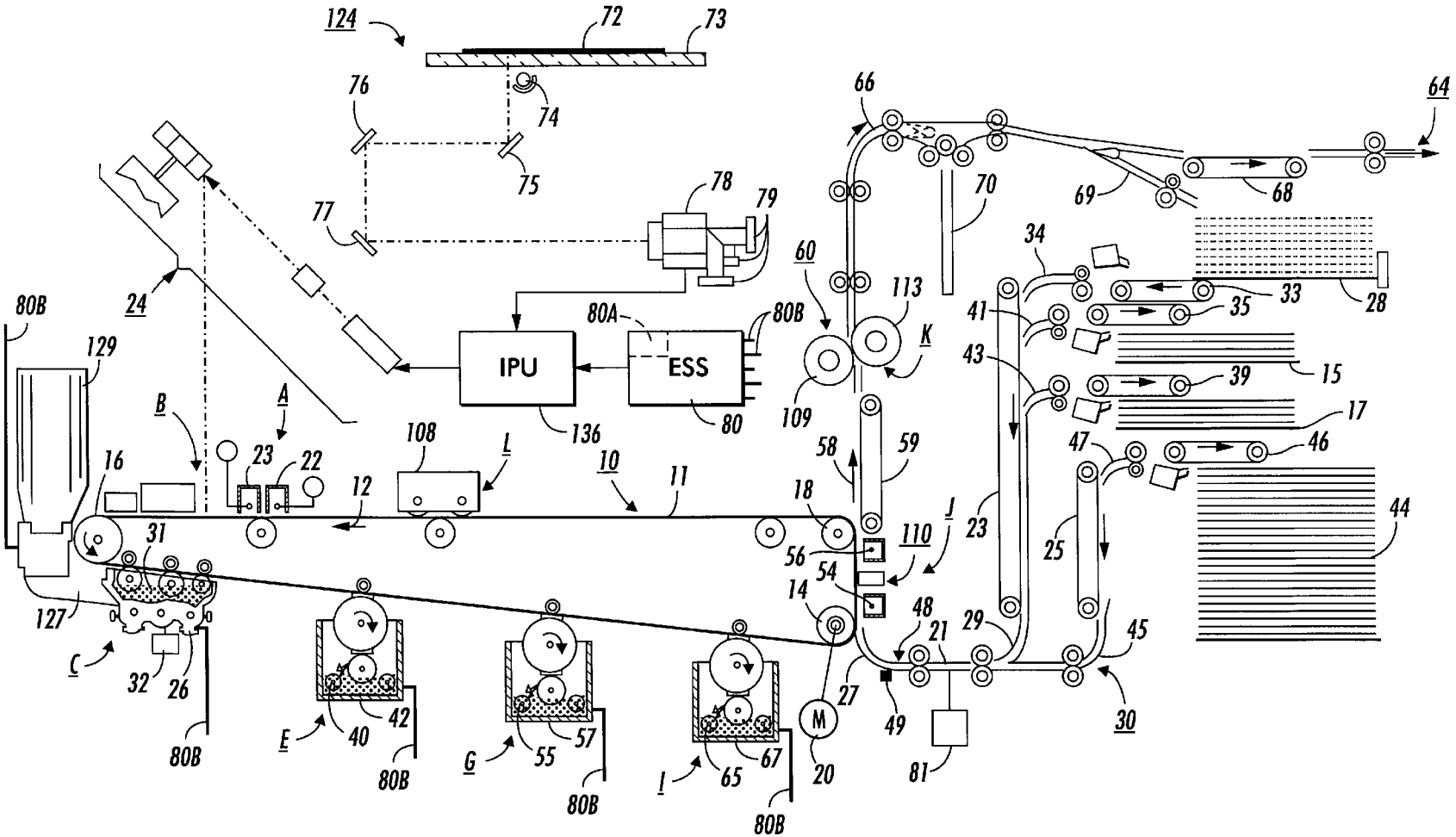
FIG. 1 is a schematic illustration of an exemplary electrostatographic reproduction machine incorporating dual mode development unit operating time control apparatus and method in accordance with the present invention.

For a general understanding of the features of the present invention, reference is made to the drawings, wherein like reference numerals have been used throughout to identify the same or similar elements. On the contrary, the following description is intended to cover all alternatives, modifications, and equivalents, as may be included within the spirit and scope of the invention as defined by the appended claims.

Referring to FIG. 1, there is depicted an exemplary electrostatographic reproduction machine, such as a multipass color electrostatographic reproduction machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the apparatus and method for dual mode control of the operating or "on" time for the development units of the machine 8 (to be described in detail below).

The ESS is preferably a self-contained, dedicated mini-computer having a central processor unit (CPU), electronic storage, and a display or user interface (Ul). The ESS is the control system which with the help of sensors and connections 80B as well as a pixel counter 80A, reads, captures, prepares and manages the image data flow between IPU 136 and image input terminal 122, 124. In addition, the ESS 80 is the main multi-tasking processor for operating and controlling all of the other machine subsystems and printing operations. These printing operations include imaging, development, sheet delivery and transfer, and particularly the operating or "on" time control mode or algorithm for the development units in accordance with the present invention. Such operations also include various functions associated with subsequent finishing processes. Some or all of these subsystems may have micro-controllers that communicate with the ESS 80.

The multipass color electrostatographic reproduction machine 8 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, in a first imaging pass, the photoreceptor 10 passes through charging station A where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station B. At imaging station B, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separatiom image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. A special feature of non-interactive development is that adding and admixing can continue even when development is disabled. Therefore the timing algorithm for the adding and admixing function can be independent of that for the development function, as long as admixing is enabled whenever development is required. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 8.

Accordingly, different jobs of several documents being reproduced, will cause toner depletion at different rates depending on the sustained, copy sheet area toner coverage, or toner area coverage level of the images thereof being reproduced. In a machine using two component developer material as here, such depletion undesirably changes the concentration of such particles in the developer material. In order to maintain the concentration of toner particles within the developer material (in an attempt to insure the continued quality of subsequent images), the adding and admixing function of the development unit must be operating or turned "on" for some controlled period of time in order for the device 127 to replenish the development unit such as 26 with fresh toner particles from the source 129. Such fresh toner particles must then be admixed with the carrier particles in order to properly charge them triboeletrically.

On the second and subsequent passes of the multipass machine 8, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 8, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station E, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 8, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station G. An example of a suitable third color toner is magenta. Suitable electrical biasing of the development unit 57 is provided by a power supply, not shown.

On the fourth pass of the multipass machine 8, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station I. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member 50 negatively charges all toner particles to the required negative polarity to ensure proper subsequent transfer.

Since the machine 8 is a multicolor, multipass machine as described above, only one of the plurality of development units, 26, 42, 57 and 67 may have its development function turned "on" and operating during any one of the required number of passes, for a particular color separation image development. The remaining development units must thus have their development functions turned off. As pointed out above and to be addressed below, the conventional approach is to use the same timing for the development function and the adding and admixing function, which causes design and operating conflicts in determining and effecting a control method for the "on" time for each development unit, particularly during sustained high area toner coverage jobs, in order to insure continued reproduction of high quality images without risking a quality or productivity degradation, or customer dissatisfaction.

Still referring to FIG. 1, during the exposure and development of the last color separation image, for example by the fourth development unit 6,7 a sheet of support material is advanced to a transfer station J by a sheet feeding apparatus 30. During simplex operation (single sided copy), a blank sheet may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 each hold a different sheet type. The speed of the sheet is adjusted at registration transport 21 so that the sheet arrives at transfer station J in synchronization with the composite multicolor image on the surface of photoconductive belt 10. Registration transport 21 receives a sheet from either a vertical transport 23 or a high capacity tray transport 25 and moves the received sheet to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

The pretransfer baffle 27 guides the sheet from the registration transport 21 to transfer station J. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10. After transfer, the sheet continues to move, in the direction of arrow 58, onto a conveyor 59 that advances the sheet to fusing station K.

Fusing station K includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multi-color toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed at cleaning station L using a cleaning brush structure contained in a unit 108.

Referring now to FIGS. 1–3, and in particular to FIG. 2 (Prior Art), multipass color electrostatographic reproduction machines are usually designed so that they each have a controller, for example ESS 80, that includes a fixed development unit operating or on time control algorithm or method which is optimized for typical operating conditions of each machine. For example, in continuous operation of a four color four pass electrostatographic reproduction machine, each development unit is typically controlled to add, mix and develop toner for approximately 25% of the total machine operating time. Unfortunately, such a controller usually requires performance tradeoffs when the machine is operating and producing reproductions or images each having high area toner coverage. Such high area toner coverage images of course, consequently require high rates of toner depletion and toner replenishment (in other words high rates of toner throughput) during the fixed operating times. In order to maintain the concentration of toner particles within the developer material of each development unit at a desired level that would insure the quality of subsequent images, the depleted toner particles must be replenished with fresh toner particles. Such fresh toner particles must then be admixed with the carrier particles in order to properly charge them triboeletrically.

Operating a four color multicolor printing machine with toner depletion and replenishment as above, involves a number of conflicts. On the one hand, in order to insure optimum toner concentration as well as optimally charged toner particles from toner replenishment and subsequent necessary admix or mixing, it would be desirable to keep all development units constantly replenishing and mixing toner particles 100% of the time when this option is enabled by the process architecture. This would spread necessary toner replenishment over the longest possible time and at the lowest possible replenishment rate. This desire is counteracted on the other hand by a need to minimize developer material aging from over mixing, and by a desire to switch development units off whenever possible in order to minimize their power consumption and audible noise. Any level of fixed development unit adding and admixing "on" time in a multipass electrostatographic reproduction machine results in a compromise in performance at some toner throughput rate as determined by area toner coverage. If the development unit adding and admixing "on" time is minimized, then image quality or productivity must be compromised at high throughput and high area toner coverage levels. If the development unit adding and admixing "on" time is maximized, then developer life, noise, and power consumption must be compromised at low throughput.

Conventionally, tradeoffs are necessary because it is very difficult to design toner materials and compact mixing apparatus which enables high image quality while replenishing toner at 100% of the maximum depletion rate (that is, at 100% area coverage). Maintaining constant toner concentration at area toner coverage levels above 50%, the resultant high replenishment and admix rates often result in undesirable side effects such as background development and excessive contamination. One possible way to avoid these side effects is to limit the maximum toner dispense rate to approximately 50% of the maximum toner depletion rate. In sustained operation at high area toner coverage levels, this will cause the toner concentration to decline by a large amount and will produce objectionable degradation of image quality. Another common solution is to suspend imaging when the toner concentration has fallen by a small amount and allow the development unit and toner dispenser to run and mix until toner is replenished to normal levels, thereby sacrificing productivity (measured by prints per unit time). This however may result in customer dissatisfaction with the operation of the machine, particularly with small development unit capacity machines.

Referring still to FIGS. 1 to 3, the multipass color electrostatographic reproduction machine 8 of the present invention is suitable for reliably producing high quality toner particle images under varying sustained area toner coverage conditions. As shown, the reproduction machine 8 includes the movable image bearing member or photoreceptor 10 having an image bearing surface 11 defining a path of movement thereof. It also includes the controller or ESS 80 and electrostatographic latent imaging elements such as 22 and 24, mounted along the path of movement for forming a latent image on the image bearing surface 11. Also provided is a plurality of development units 26, 42, 57, and 67, each having a mixing chamber holding developer material containing carrier particles and toner particles for developing the latent image on the surface 11. Each such development unit includes adding and admixing means such as 129, 127, having an operating time mode comprising a first operating time mode and a second operating time mode, for adding fresh toner particles to the chamber and admixing same in order to replenish toner particles depleted by development of the latent image.

Importantly, each of the development units 26, 42, 57, and 67 are each connected by connectors 80B to the ESS 80, and the electrostatographic latent imaging elements, for example, 24 is connected via the image processing unit (IPU) 136 to a pixel counter 80A of the ESS 80. As such, the ESS 80 is suitable for controlling, for example, the adding and admixing "on" time as well as the development "on" time mode or algorithm independently for each development unit. Importantly, the ESS 80 has a stored area toner coverage level threshold value, for example 50% (FIGS. 3) against which to make decisions for selecting a mode of control for the "on" time of the development units.

The pixel counter 80A operates to capture latent image pixels being formed for development for each image of a job being reproduced, and can thus calculate and determine both area toner coverage levels and toner depletion. A pixel counter of the sort is disclosed for example in U.S. Pat. No. 5,349,377 issued Sep. 20, 1994, relevant portions of which are herein incorporated by reference. Thus the pixel counter 80A is a means for measuring sustained area toner coverage levels of images of a job being reproduced. The ESS 80 further includes means for comparing the measured sustained area toner coverage levels of images being reproduced with the stored area toner coverage level threshold value, for example, 50%; as well as means for automatically changing the operating time mode 300 (FIG. 3) of adding and admixing in each development unit between the first operating time mode 304 and the second operating time mode 306 depending on a result of comparing the measured sustained area toner coverage levels of images being reproduced with the threshold value TV.

Referring in particular to FIGS. 2 and 3, each is a graphical illustration of a mode or method of controlling development unit adding and admixing "on" time at various levels of sustained area toner coverage. The vertical axis of each graph measures the adding and admixing "on" time for each development unit as a percent, 0% –50% –100%, for example, of the total "on" time of all the development units during reproduction of the images of a job. It also measures the quality and productivity of the development unit at the various area toner coverage levels. The horizontal axis in each graph, measures the area toner coverage levels.

With particular reference to FIG. 2, there is illustrated conventional or prior art undesirable drop 206 in productivity or quality 202 of images being reproduced, as area toner coverage (horizontal axis) thereof increases above some threshold value TV, for example 50% when the adding and admixing "on" time control mode or algorithm 200 for each development unit is fixed throughout, at say 50%. As is clear from FIG. 2, the quality and productivity 204 of images being reproduced are acceptable for area toner coverage levels of 50% or less when the method of operating each development unit for toner replenishment and admixing is a fixed time period, expressed as a percentage of the time period during which all the development units are operating as such. However, where the sustained area toner coverage of images being reproduced is measured at increased levels higher than the 50%, such quality and productivity 206 undesirably drops. Thus 100% productivity can be sustained given 50% or less area coverage, but steadily declines thereafter for 50% to 100% coverage. This conventional approach when applied to a multipass multicolor machine in which productivity is sacrificed to maintain high image quality at high toner area coverage leads to customer dissatisfaction.

However, in accordance with the present invention, as illustrated in FIG. 3, in order to maintain the quality and productivity 302 at an acceptable level (100%), each development unit includes a dual operating time control system or mode 300 for adding fresh toner particles to its chamber and admixing same. The dual operating time control system or mode 300 comprises a first operating time mode 304 which is fixed, and a second operating time mode 306 which is proportional to the measured sustained area toner coverage level. Thus quality and productivity are sustained at 100% (that is, with no decline) for area toner coverage levels of 0% –100%.

In other words, in a multicolor machine the dual operating time control system or mode 300 includes for each development unit a fixed development unit adding and admixing time method 304 when the sustained area toner coverage is less than say 50%, and an adaptive development unit adding and admixing time method 306 that is a function of the present (or integrated recent) area toner coverage for each color. As disclosed above, the area toner coverage (horizontal axis FIGS. 2 and 3) is determined through the pixel counting feature 80A already resident in the controller, ESS 80. Thus in accordance with the present invention, rather than sacrificing productivity or image quality 302 at high area coverage, there is instead a temporary sacrifice of a small amount of power consumption, audible noise, and developer life at high area coverage. It is believed that such a trade off will result in greater customer satisfaction by allowing more optimal tradeoffs among productivity, toner dispense rate, power consumption, audible noise, and developer aging when operating at high area toner coverage levels. At low and high area toner coverage levels, the method of the present invention can be implemented simply by making the turn-on and turn-off times for the adding and admixing function of each color development unit a simple linear function of the measured pixel count for that color, since such a count closely approximates the area toner coverage for that color.

It is, therefore, evident that there has been provided, in accordance with the present invention a method and apparatus in an electrostatographic reproduction machine having a plurality of development units for reliably producing high quality toner particle images under varying sustained area toner coverage conditions. The apparatus employing the method includes a control system (a) for reading a stored area toner coverage level threshold value; a first operating time control algorithm and a second operating time control algorithm for adding and admixing within each development unit of the plurality of development units; (b) for measuring sustained area toner coverage levels of images being reproduced during a reproduction job; (c) for comparing the measured sustained area toner coverage levels of images being reproduced with the stored area toner coverage level threshold value; and (d) for changing the operating time control algorithm of adding and admixing within each development unit between the first operating time control algorithm and the second operating time control algorithm depending on a result of comparing the measured sustained area toner coverage levels of images being reproduced with the stored threshold value.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claim is:

1. A multicolor electrostatographic reproduction machine for reliably producing high quality toner particle images under varying sustained toner area coverage conditions, the reproduction machine comprising:

(a) a movable image bearing member having an image bearing surface defining a path of movement thereof;

(b) electrostatographic latent imaging elements mounted along said path of movement for forming a latent image on said image bearing surface;

(c) a plurality of development units, each having a mixing chamber holding developer material containing carrier particles and toner particles for developing said latent image, each development unit having a first operating time mode comprising a first operating time mode for minimizing developer material aging, developer unit power consumption and developer unit audible noise, and a second operating time mode, for maintaining high quality toner image production despite increased power consumption and audible noise; and (d) a control system having a stored toner area coverage level threshold value, said control system being connected to said electrostatographic latent imaging elements and to said each development unit for changing an actual operating time of said each development unit from one to another of said first, and said second, operating time modes, depending on a comparison of an actual measured level of toner area coverage, during a given image reproduction job, with said stored toner area coverage level threshold value.

2. The electrostatographic reproduction machine of claim 1, wherein said plurality of development units comprises at least two development units.

3. The electrostatographic reproduction machine of claim 1, wherein said first operating time mode comprises a fixed period of time equivalent to a percentage of a period of time used by said plurality of development units for adding and admixing fresh toner during a given image reproduction job.

4. The electrostatographic reproduction machine of claim 1, wherein said stored area toner coverage level threshold value comprises 50% area toner coverage.

5. The electrostatographic reproduction machine of claim 1, wherein said first operating time mode comprises a fixed period of time equivalent to a percentage of a period of time used by said plurality of development units for adding and admixing fresh toner during a given image reproduction job, and said second operating time mode comprises a period of time proportional to said measured sustained area toner coverage levels.

6. The electrostatographic reproduction machine of claim 5, wherein said first operating time mode comprises a fixed period of time equivalent to a percentage of a period of time used by said plurality of development units for adding and admixing fresh toner during a given image reproduction job having measured sustained area toner coverage levels up to 50%, and said second operating time mode comprises a period of time proportional to measured sustained area toner coverage levels greater than 50%.

7. The multicolor electrostatographic reproduction machine of claim 1, wherein said control system for controlling said each development unit includes:

(i) means for measuring sustained toner area coverage levels of images being reproduced;

(ii) means for comparing said measured sustained toner area coverage levels of images being reproduced with said stored toner area coverage level threshold value: and (iii) means for changing said operating time mode of said each development unit between said first operating time mode and said second operating time mode depending on a result of comparing said measured sustained toner area coverage levels of images being reproduced with said stored toner area coverage level threshold value.

8. A method in a multicolor electrostatographic reproduction machine having a plurality of development units for reliably producing high quality toner particle images under varying sustained toner area coverage conditions, the method comprising the steps of:

(a) reading a stored toner area coverage level threshold value; and for each development unit of the plurality of development units, reading a first operating time control algorithm for minimizing developer material aging, developer unit power consumption and developer unit audible noise, and a second operating time control algorithm, for maintaining high quality toner image production despite increased power consumption and audible noise;

(i) measuring sustained toner area coverage levels of images being reproduced during a reproduction job;

(ii) comparing the measured sustained toner area coverage levels of images being reproduced with the stored toner area coverage level threshold value; and (iii) changing the operating time control algorithm of each development unit between the first operating time control algorithm and the second operating time control algorithm depending on a result of comparing the measured sustained toner area coverage levels of images being reproduced with the stored toner area coverage level threshold value.

9. The method of claim 8, wherein said reading step comprises reading a stored area toner coverage level threshold value equal to 50% area toner coverage.

10. The method of claim 8, wherein said reading step comprises reading a first operating time control algorithm equal to a fixed time period.

11. The method of claim 8, wherein said reading step comprises reading a second operating time control algorithm in which the operating time period is a function of the measured area toner coverage level.

12. The method of claim 8, wherein said measuring step comprises counting and summing pixels of latent images formed by the latent image forming devices and developed by the plurality of development units.

* * * * *